US006537184B2

(12) United States Patent
Kim

(10) Patent No.: US 6,537,184 B2
(45) Date of Patent: Mar. 25, 2003

(54) SWING EXERCISER

(75) Inventor: Yong Woo Kim, Rochester, NY (US)

(73) Assignee: Kellion Corporation, Rochester, NY (US)

( * ) Notice: Subject to any disclaimer, the term of this patent is extended or adjusted under 35 U.S.C. 154(b) by 0 days.

(21) Appl. No.: 09/792,225

(22) Filed: Feb. 22, 2001

(65) Prior Publication Data

US 2002/0115540 A1 Aug. 22, 2002

(51) Int. Cl.[7] ..... A63B 21/02

(52) U.S. Cl. ..... 482/122; 482/109; 482/101; 473/131

(58) Field of Search ..... 482/122, 109, 482/148, 93, 100; 473/131; 273/186 R, 191, 192, 351, 186; 434/252

(56) References Cited

U.S. PATENT DOCUMENTS

| | | | | |
|---|---|---|---|---|
| 3,462,156 A | 8/1969 | Gentry | 273/186 |
| 3,618,942 A | 11/1971 | Bates | 272/82 |
| 3,966,203 A | 6/1976 | Bickford | 272/118 |
| 4,135,714 A | 1/1979 | Hughes | 272/136 |
| 4,229,002 A | 10/1980 | Masters | 272/117 |
| 4,231,568 A | 11/1980 | Riley et al. | 272/136 |
| 4,243,219 A | 1/1981 | Price | 272/117 |
| 4,253,663 A | 3/1981 | Hughes | 272/136 |
| 5,050,874 A | 9/1991 | Fitch | 272/136 |
| 5,242,344 A | 9/1993 | Hundley | 482/93 |
| 5,269,512 A | 12/1993 | Crowson et al. | 273/26 R |
| 5,284,464 A | 2/1994 | Lee, III et al. | 482/121 |
| 5,586,962 A | 12/1996 | Hallmark | 482/129 |
| 5,816,928 A | 10/1998 | Colonna | 473/229 |

*Primary Examiner*—Nicholas D. Lucchesi
*Assistant Examiner*—Lori Baker Amerson
(74) *Attorney, Agent, or Firm*—Eugene Stephens & Associates; Eugene S. Stephens

(57) ABSTRACT

A swing exerciser especially suitable for golf exercise uses a handle and cord arranged to move a resistance trolley down a track positioned on the golfer's back swing side. A spring and pulley arrangement resists movement of the trolley down the track, and movement of the handle by the golfer through the curve of a golf swing forces the trolley down the track so that the golf exerciser must overcome the resistance while swinging the handle to strengthen the muscles needed for powerfully hitting a golf ball.

38 Claims, 12 Drawing Sheets

SWING EXERCISER

TECHNICAL FIELD

Equipment for strengthening muscles used in swinging motion for sports purpose.

BACKGROUND

The prior art has generally recognized the benefits of strengthening muscles needed for swinging sports implements, and specifically for golf club swinging muscles, the prior art contains several suggestions. All of these are problematic for various reasons and none has become widely used.

Most of the patents suggesting golf swing exercisers apply a swing resistance that remains in a fixed location during the swing. This fails to orient the resistance in an effective direction throughout the swing, as can be seen from U.S. Pat. Nos. 4,229,002; 4,135,714; 4,253,663; 3,462,156 and 3,966,203.

A few other patents, including U.S. Pat. Nos. 5,050,874 and 5,284,464 suggest a swing resistance mounted on a central pivot so that the resistance follows a circular arc as the swing proceeds. This also is less than optimum, because a golf swing differs significantly from a circular arc.

Another U.S. Pat. No. 5,242,344 suggests a more complex movement of a swing resistance, but this requires a cumbersome and complex machine.

My invention aims at a swing exerciser applicable to sports implements generally and especially suitable for exercising muscles used in a golf swing by applying a resistance in an amount and a direction that are effectively matched to the force and direction requirements of the swing. My invention also keeps the necessary equipment simple so that swing exercising can be accomplished in an especially effective way without undue expense.

SUMMARY

My swing exerciser is especially appropriate for a golf swing, since a golf swing extends through many feet of a complex curve as it proceeds from a back swing region to a hitting region. My invention keeps a resistance properly oriented to effectively resist advance of a golf handle through different regions of a golf swing so that a golf exerciser can feel comfortable and natural in a swing exercise. My swing exerciser can also be adapted to produce the same benefits for the swinging of sports implements other than golf clubs.

Since most of the muscle force applied in hitting a golf ball is concentrated in the swing's approach to a hitting region, my invention applies significantly increased resistance in this region of the swing. This makes the muscles work especially hard as the golf handle approaches the hitting region, which effectively develops the muscle strength necessary for applying power to the golf swing.

My swing exerciser accomplishes these benefits by using a resistance that moves along a line as the swing proceeds. This allows proper orientation of a resistance cord that extends between a handle and the resistance moving along the line. My moveable resistance is also arranged to increase the resistance to handle movement as the handle approaches the hitting region so as to require a greater muscle force and more effective muscle exercise as the swing handle is driven into the hitting region.

DRAWINGS

DETAILED DESCRIPTION

Figure 1:
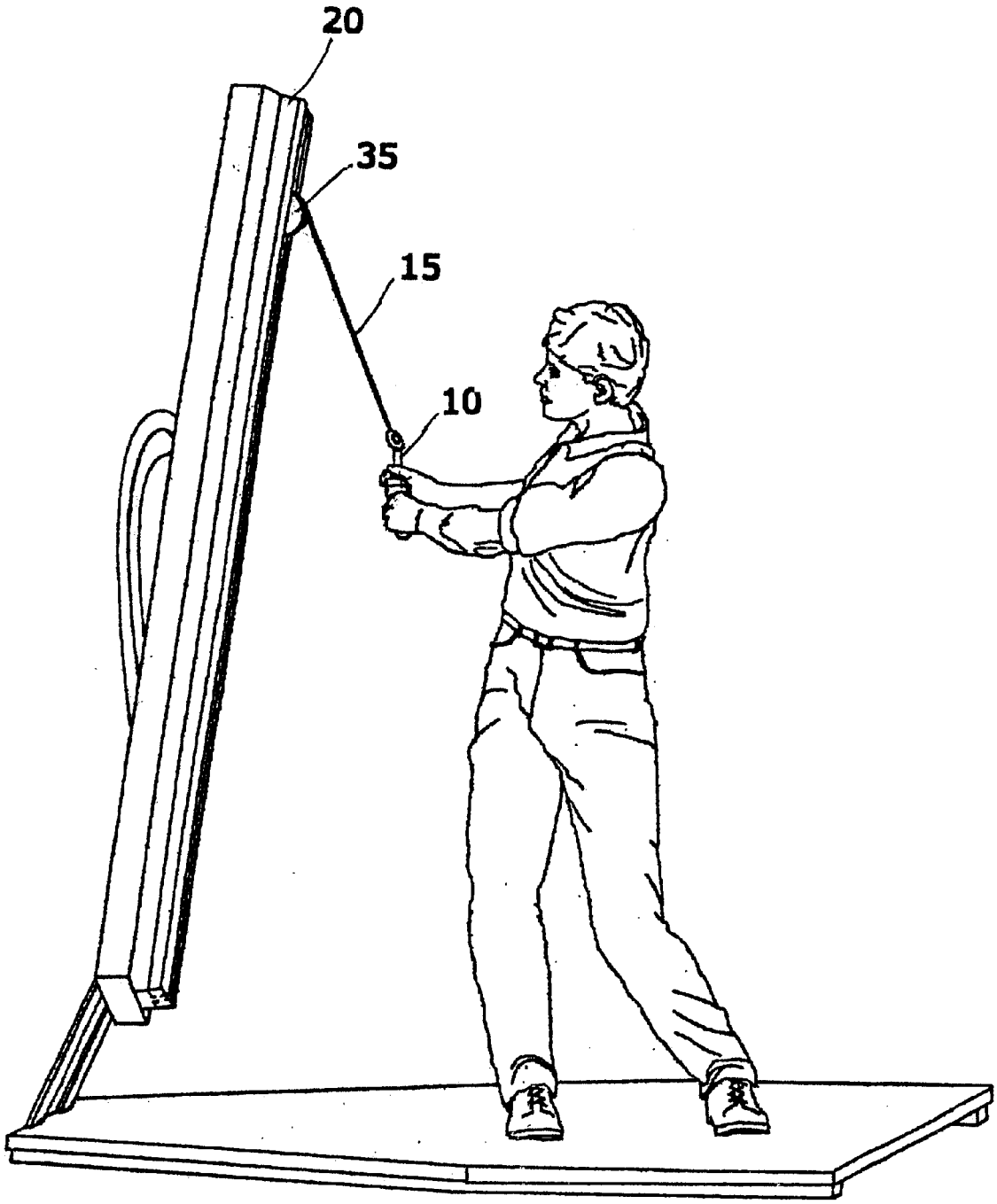
FIGS. 1 and 2 show a partially schematic preferred embodiment of a golf exerciser version of the inventive swing exerciser using a single resistance cord shown in the back swing position in FIG. 1 and at the hitting region in FIG. 2.
Figure 2:
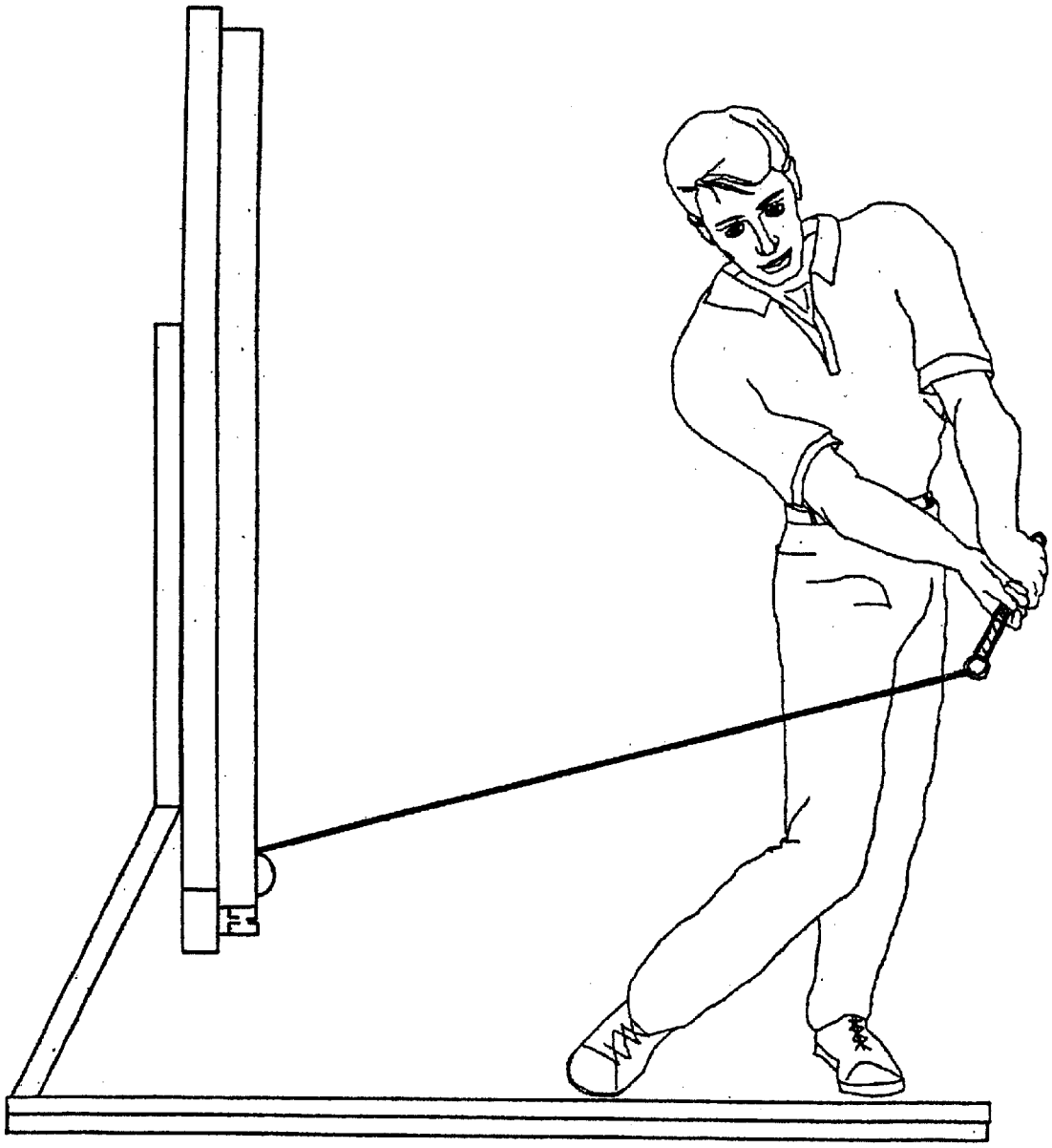
Figure 3:
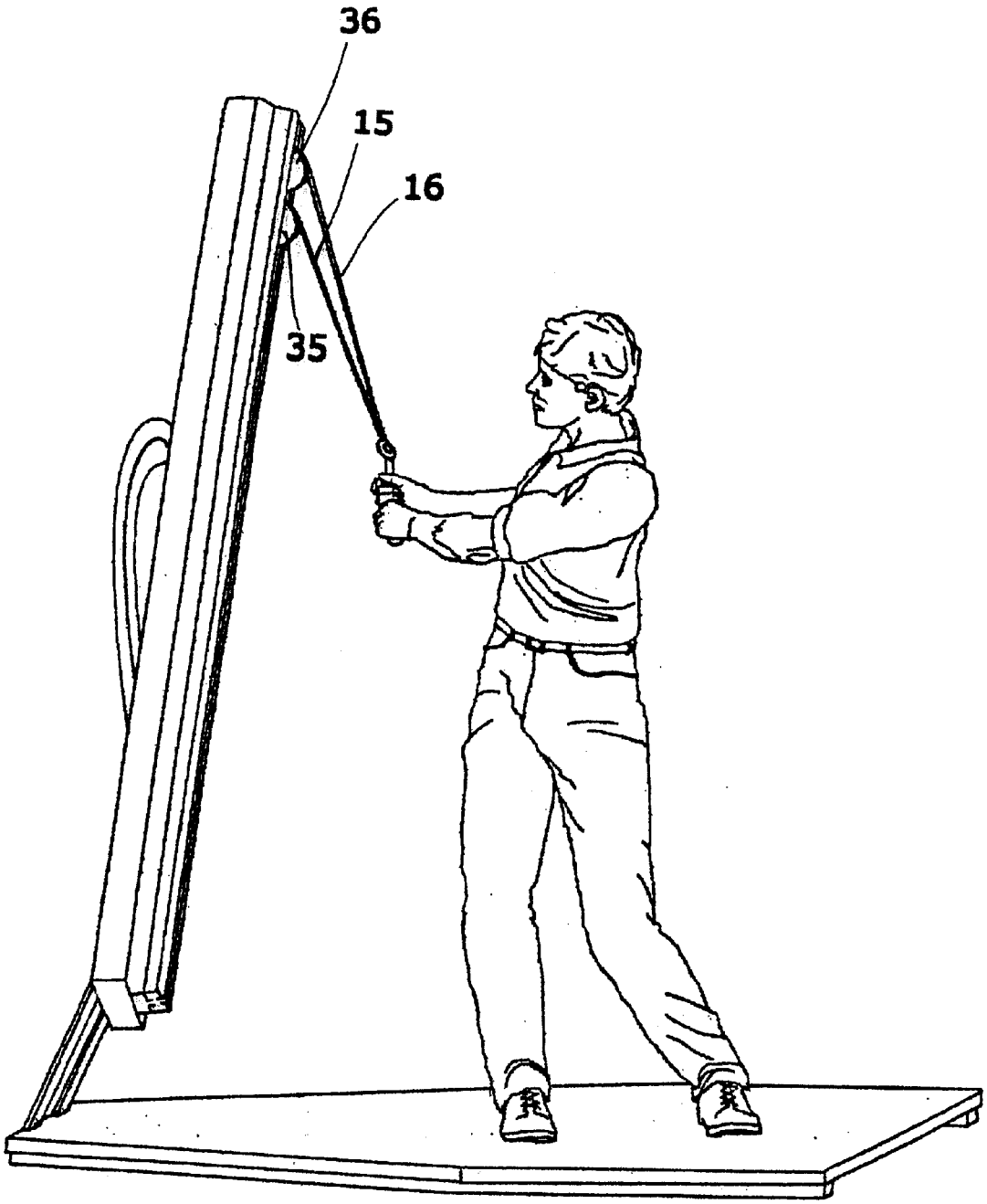
FIGS. 3 and 4 show a partially schematic alternative preferred embodiment of the inventive swing exerciser using a pair of resistance cords shown in the back swing position in FIG. 3 and in the hitting region in FIG. 4.
Figure 4:
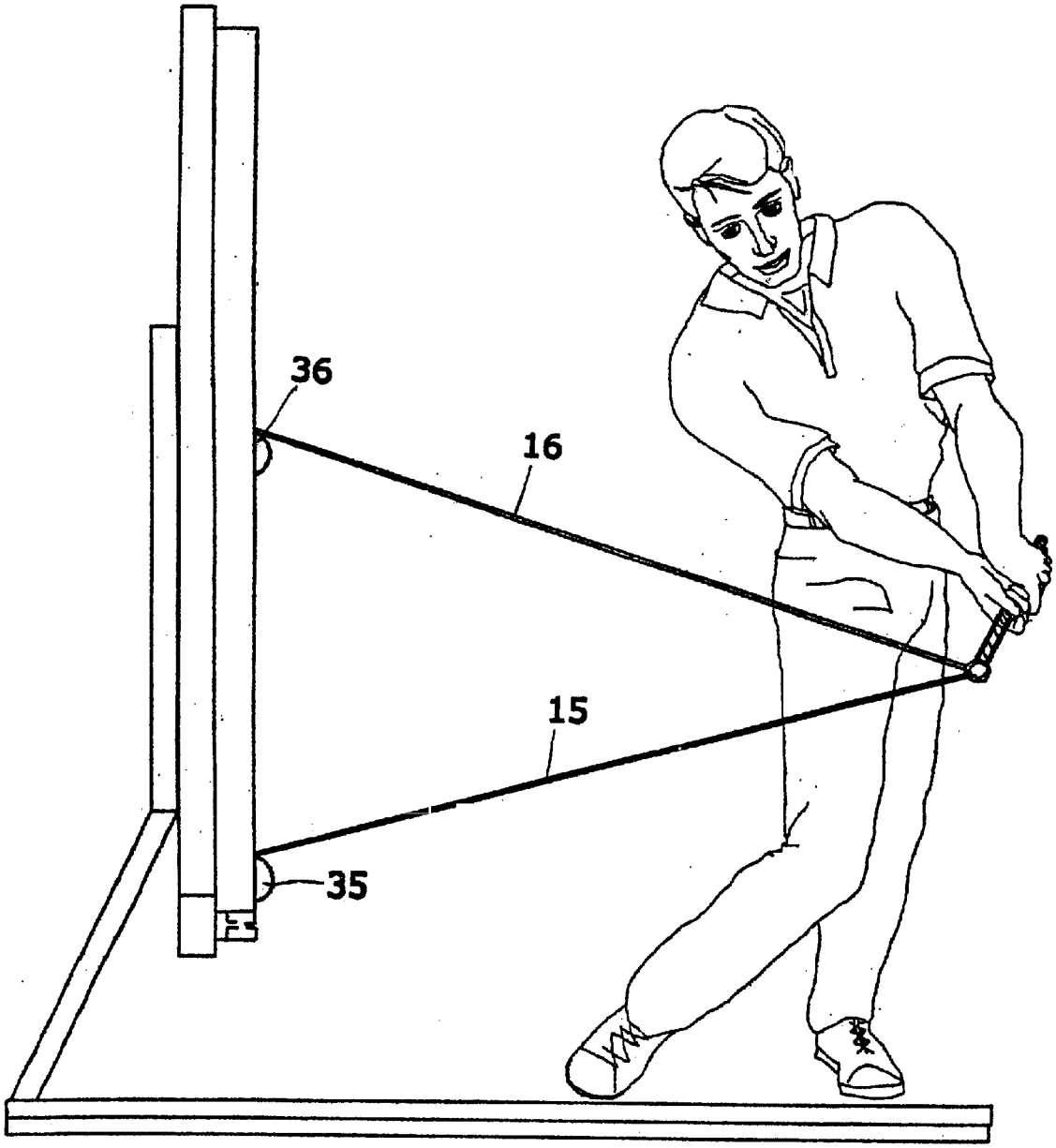

FIGS. 1–5 illustrate two preferred embodiments of a swing exerciser dedicated to golf. These involve a handle 10, a line of movement or run in the form of a slotted track 20, and at least one resistance cord 15 extending between the handle and a pulley 35 on a moveable element or runner in the form of a trolley moveable along the track as the swing proceeds. The beginning of a back swing position is shown in FIGS. 1 and 3 and the hitting position is shown in FIGS. 2 and 4. A side view of the double pulley and double resistance cord version of the exerciser of FIGS. 3 and 4 appears in FIG. 5. The single resistance cord and trolley version of FIGS. 1–3 has a similar side view appearance.

Pulley 35 starts at the top of track 20, as shown in FIG. 1, at the beginning of a swing exercise and moves to the bottom of track 20 as the swing approaches the hitting region, as shown in FIG. 2. This movement of pulley 35 down track 20 is resisted so that the exerciser has to apply force to handle 10 to overcome the resistance and thereby exercise and strengthen the muscles used in executing the swing.

For an exerciser version with two pulleys 35 and 36, as shown in FIGS. 3 and 4, the pulleys start near the top of track 20 at the beginning of a swing and move down track 20 by different distances as the swing advances. When the swing reaches the hitting region, as shown in FIG. 4, lower resistance cord 15 extends below horizontal to lower pulley 35 near the bottom of track 20, while upper resistance cord 16 extends above horizontal to upper pulley 36, which has moved part way down track 20. The swing exerciser must overcome resistance applied to trolleys bearing both pulleys 35 and 36.

Figure 5:
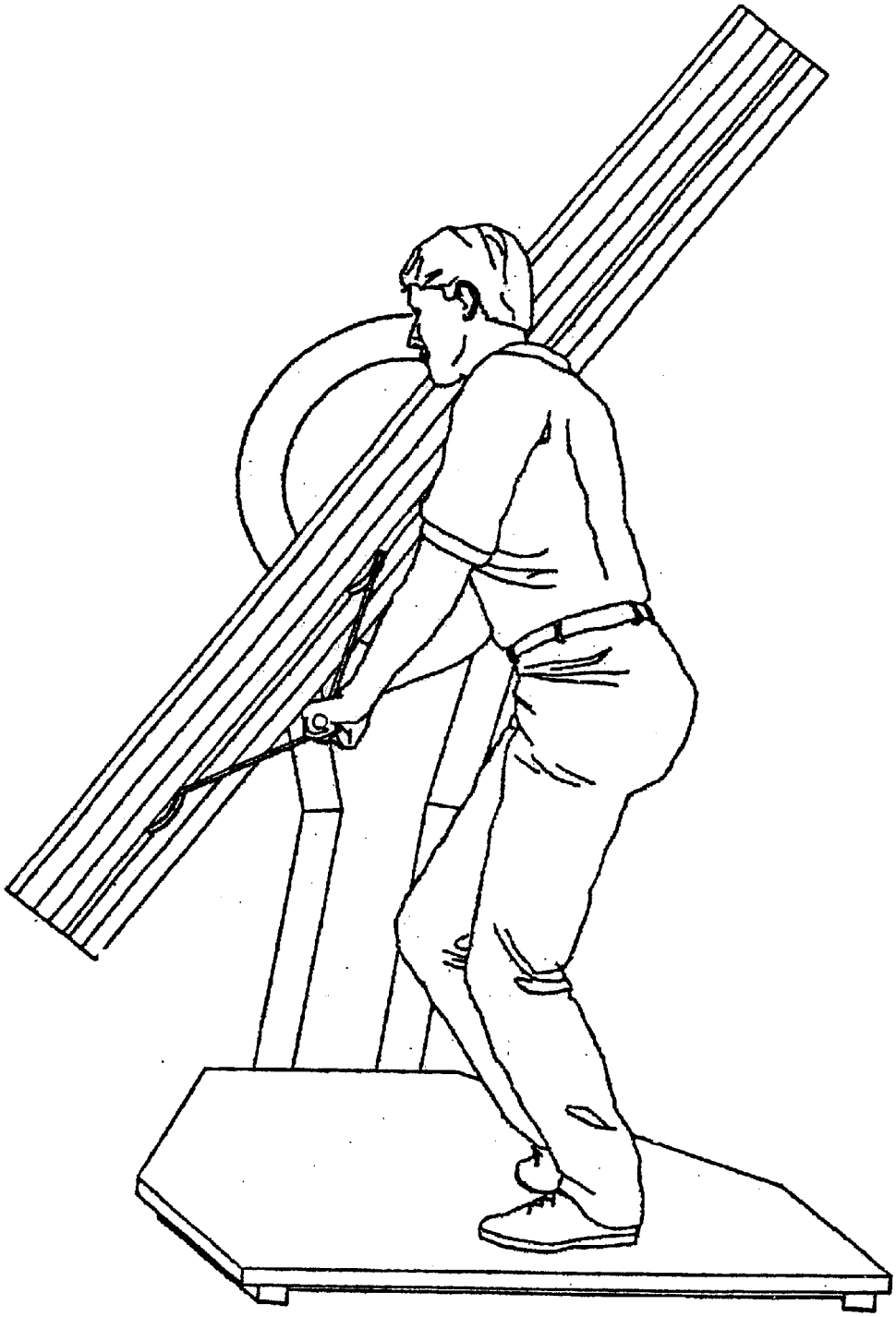
FIG. 5 is a partially schematic view of the swing exerciser of FIGS. 3 and 4 as seen from the left side of a right-handed golf exerciser.

Track 20 is preferably arranged on a back swing side of a golfer, which is on the golfer's right side for a right handed golfer as illustrated in FIGS. 1–5. Track 20 also preferably extends from above and behind the golfer's shoulders downward to forward and below the golfer's hips, as best seen in FIG. 5. This arrangement allows the golfer to take a full back swing and to proceed from a back swing position to a hitting region with resistance applied steadily as the swing progresses. This arrangement also allows the golfer to move hands and handle 10 in a natural and practiced way throughout the complex curve of a golf swing without interference from the resistance system. In effect, the golfer's swing habits do not have to change to accommodate the exercise device. Conversely, the exercise device applies swing resistance necessary to help the exerciser strengthen swing muscles without requiring the exerciser to change stance or swing habits.

Figure 6:
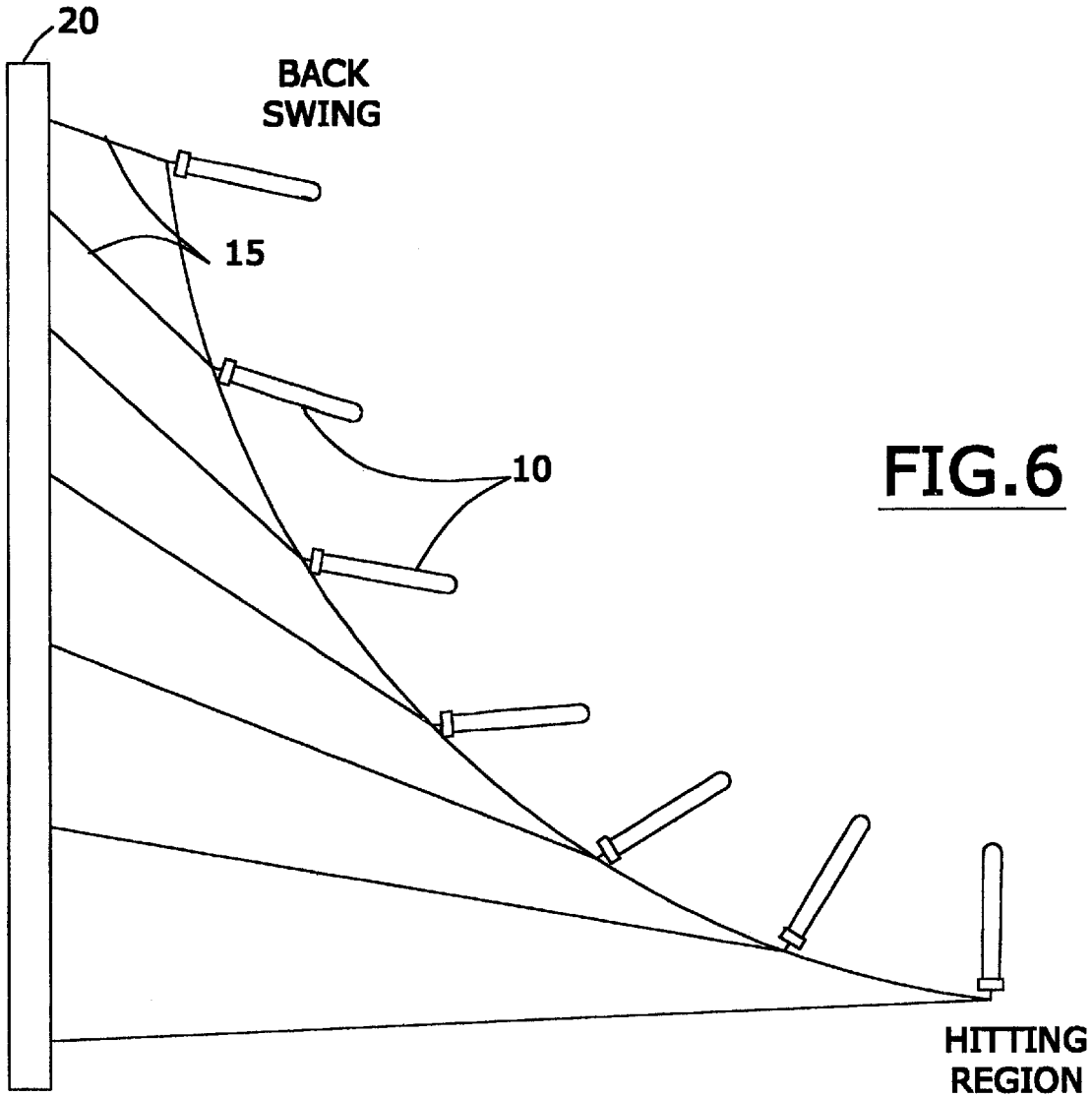
FIGS. 6 and 7 are schematic diagrams of approximate forces and directions involved in the inventive exerciser as represented by resistance cord lines extending from a golf handle to a track along which a resistance is moveable, with FIG. 6 showing a single resistance cord version, and FIG. 7 showing a double resistance cord version.
Figure 7:
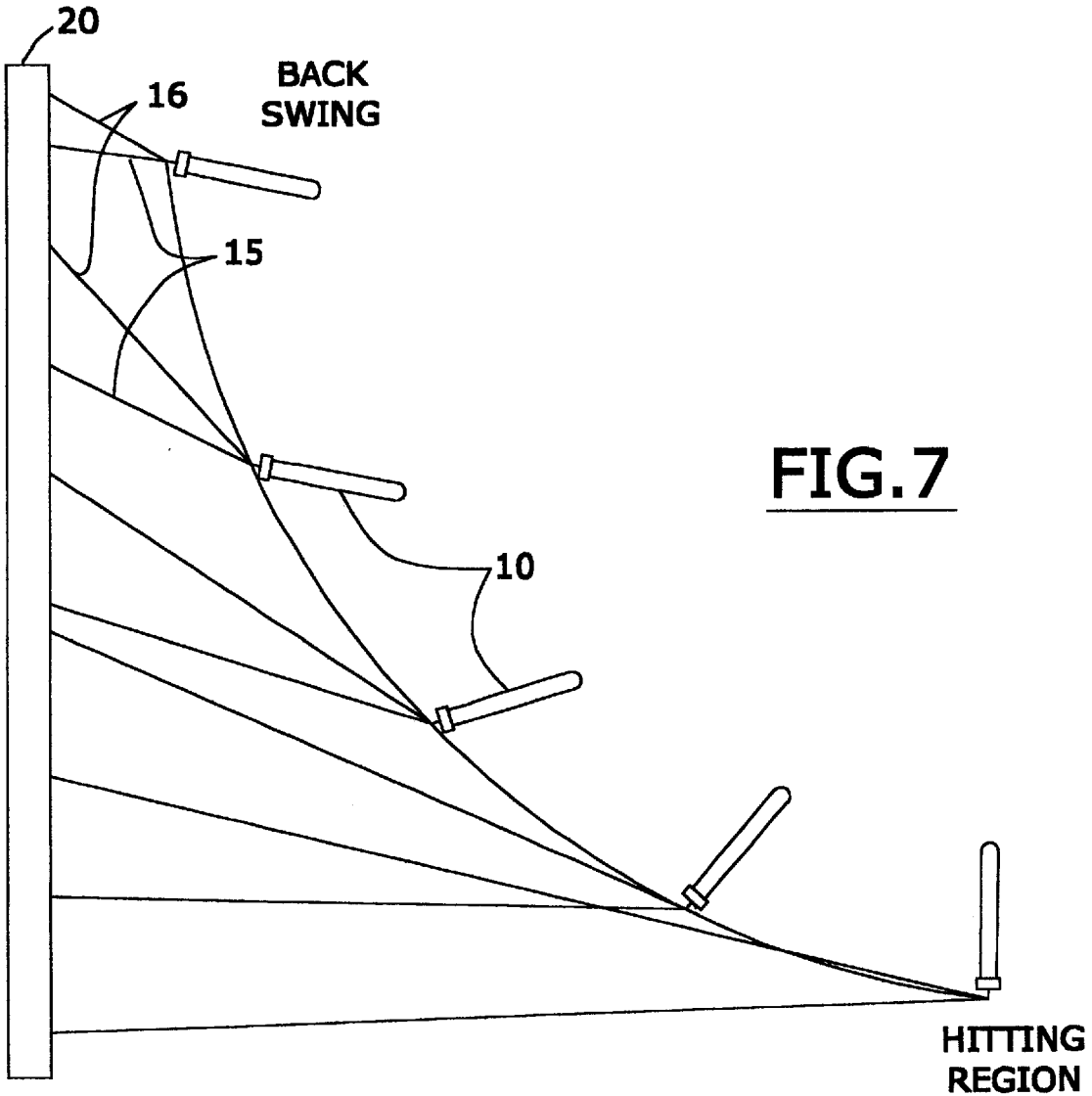

FIGS. 6 and 7 illustrate the approximate forces involved in resisting the swing of handle 10 through the curve of a golf stroke, with FIG. 6 corresponding to the embodiment of FIGS. 1 and 2 and FIG. 7 corresponding to the embodiment of FIGS. 3 and 4. In both embodiments, the swing of handle 10 is not only resisted, but the resistance is applied in variable amounts appropriate to the region of the swing through which the handle is passing. The resistance is also applied in an appropriate direction to resist advance of the handle through the golf swing, without interfering with the golfer performing the exercise.

Since resistance is preferably applied to one or two trolleys moving vertically down track 20, the resistance encountered by movement of handle 10 advancing along the curve of the golf swing is approximately proportional to the extent of downward trolley movement that curving movement of the handle causes. With this in mind, it is apparent from FIGS. 6 and 7 that movement of handle 10 downward from the back swing region begins nearly parallel with track 20 and then pulls away from track 20 as the handle moves into the hitting region. The initial movements of handle 10 advancing from the back swing region cause smaller downward movements along track 20 than are caused by movement of handle 10 pulling away from track 20 as handle 10 approaches the hitting region. This effect requires more work to move handle 10 through the hitting region than to move handle 10 downward from the back swing region and thus provides more strengthening exercise of the golfer's muscles in the hitting region than in the back swing region.

Since downward movement along track 20 is preferably resisted by springs, as explained below, and since extension springs generally increase their resistance as they are lengthened, the spring resistance to downward movement along track 20 also increases as handle 10 proceeds toward the hitting region. Spring forces thus add further to the increased work required in moving handle 10 through the hitting region.

From the golf exerciser's point of view, handle 10 moves fairly easily downward from a back swing position, with resistance constantly increasing to a maximum as the handle moves through the hitting region. For the single resistance cord embodiment of FIG. 6, the resistance to downward movement along track 20 extends for nearly the full length of the track during a complete golf swing. For the two resistance cord embodiment of FIG. 7, a lower resistance moves nearly the full length of the track, and an upper resistance preferably moves about a half a length of the track. More details on this are explained below.

Figure 9:
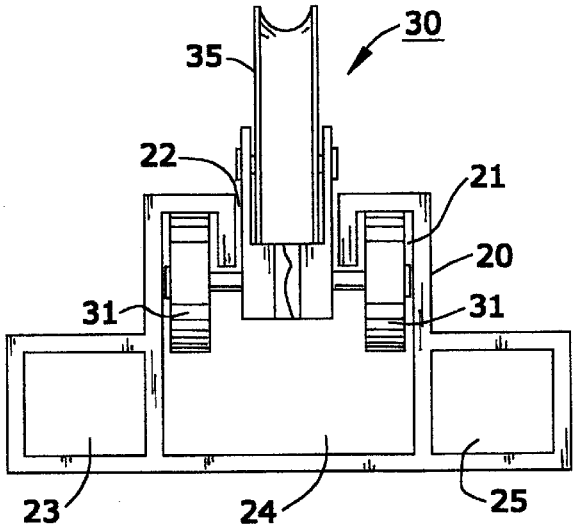
FIG. 9 is a schematic end view of a preferred embodiment of track showing a trolley moveable along the track.
Figure 10A:
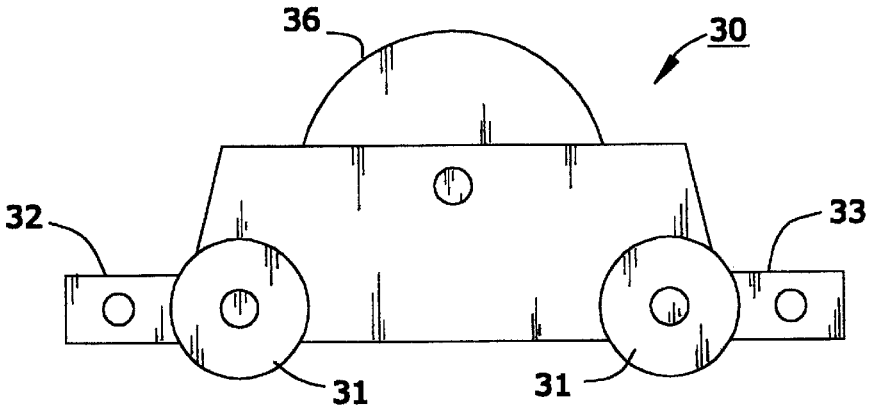
FIG. 10A is a partially schematic side elevational view of a track trolley as schematically represented in FIG. 8B.
Figure 10B:
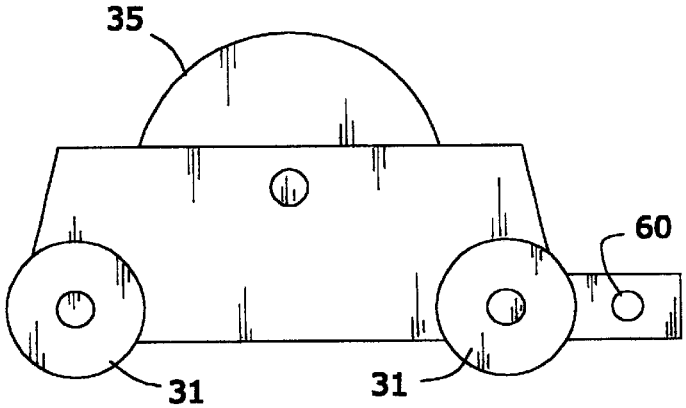
FIG. 10B is a partially schematic side elevational view of a lower track trolley as shown in FIGS. 8A and 9.

The preferred track 20 can have many different configurations, one of which is illustrated in FIG. 9. It is preferably shaped with a channel 21 having a slot 22 to accommodate travel of a trolley 30, as illustrated in FIGS. 9 and 10. Trolley 30 preferably has wheels 31 that straddle and run on opposite sides of slot 22 to hold pulley 35 or 36 in a position extending out of track slot 22. Trolley 30 otherwise has one or two end connectors 32 for connecting to resistance biases and to resistance cords.

Track 20, besides accommodating trolley 30 in channel 21 and slot 22, also preferably has other channels 23–25 to accommodate resistance spring packs, pulleys, and cord runs for block and tackle resistance systems. These are illustrated in FIGS. 8A and 8B.

Figure 8A:
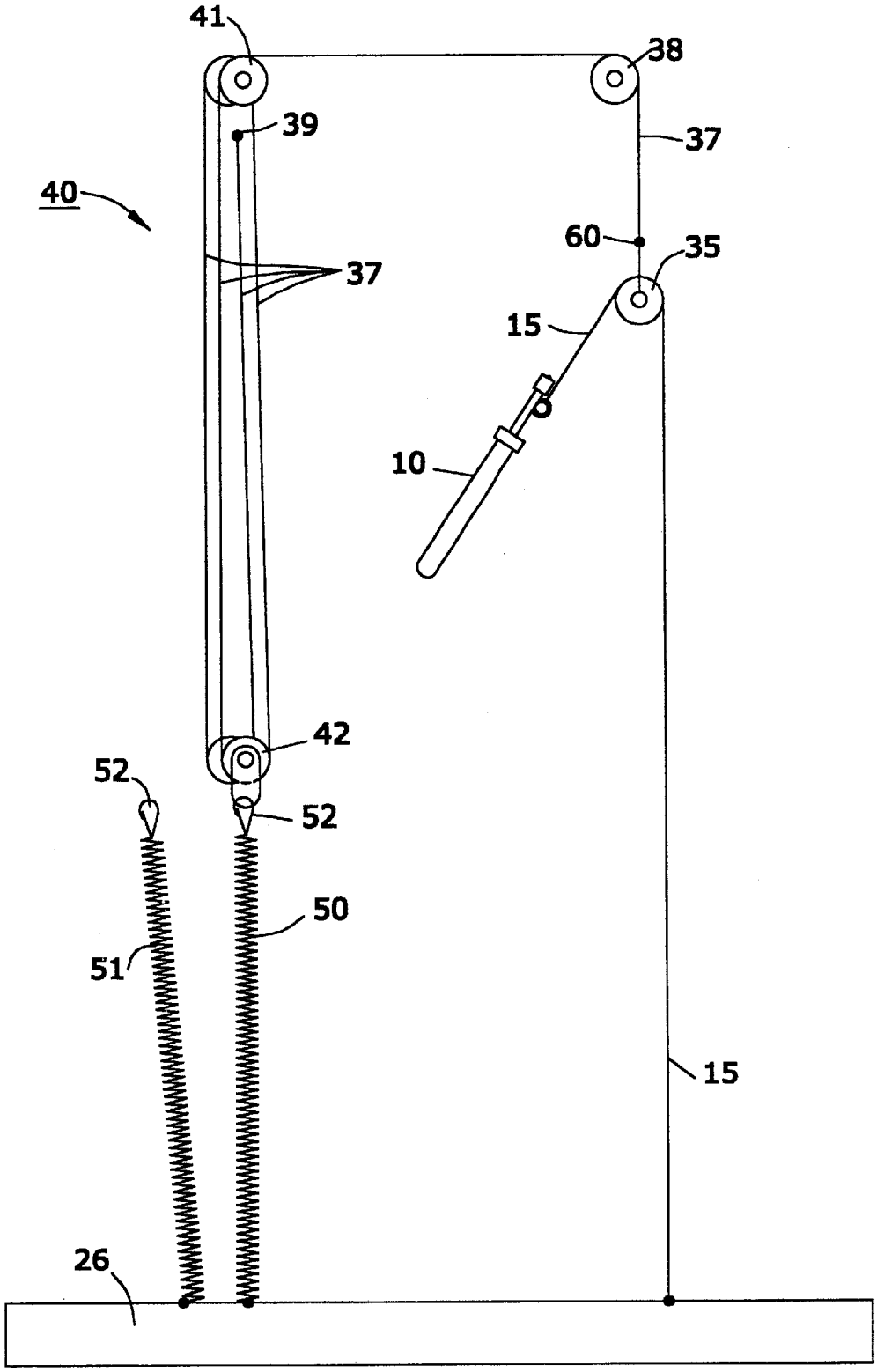
FIGS. 8A and 8B are schematic diagrams of preferred embodiments of block and tackle and spring arrangements providing resistance to a single cord reeved over a single trolley pulley in FIG. 8A and to a pair of resistance cords reeved over a pair of trolley pulleys in FIG. 8B.
Figure 8B:
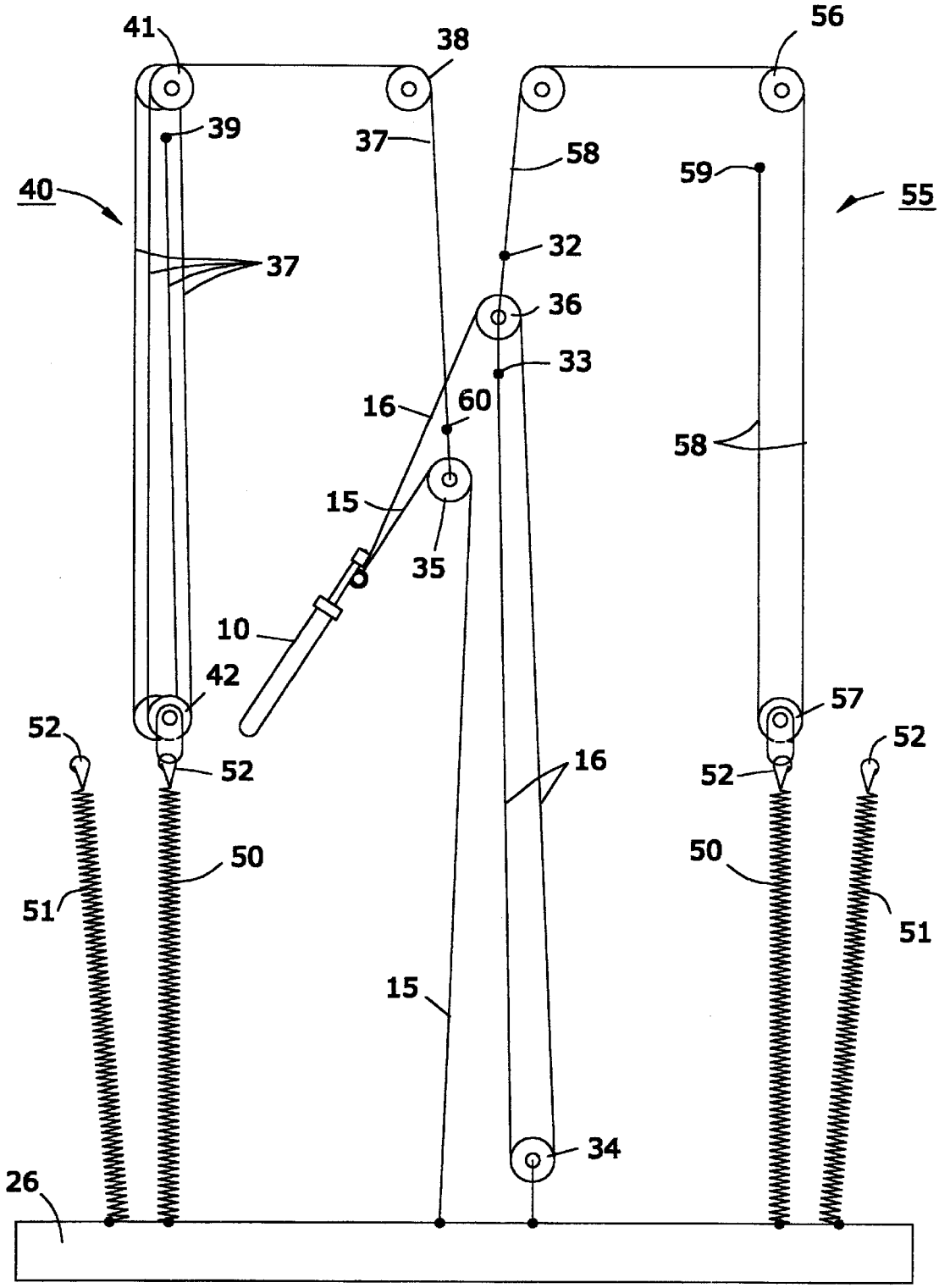

To simplify and clarify the illustration of resistance and pulley systems for trolleys moveable along track 20, FIGS. 8A and B schematically illustrate only a bottom region 26 of track 20 and otherwise expand the illustration laterally wider than would be necessary for any actual installation in a track 20. These illustrations also use pulleys 35 and 36 to represent trolleys 30 that carry such pulleys.

FIG. 8A illustrates a preferred resistance system for the single resistance cord embodiment of FIGS. 1 and 2. Resistance cord 15 extending from handle 10 and over trolley pulley 35 extends downward to a fixed point at track bottom region 26. This shows that pulling handle 10 downward and away from track 20, as shown in FIGS. 1, 2, and 6 forces trolley pulley 35 downward along the track. Resisting this movement is a block and tackle connected to trolley pulley 35 at connection point 60 by cord 37 that is reeved over a pulley 38 and through the double pulleys 41 and 42 of block and tackle 40. Cord 37 extends to an end termination 39 near upper double pulley 41.

One or more extension springs 50 connect to lower double pulley 42, preferably by snap hooks 52. Any suitable number of springs 50 can be connected to lower pulley 42, depending on the exerciser's preference for resistance force. Springs 51 that are not connected to lower pulley 42 can be conveniently disposed in a side region of track 20.

As handle 10 moves through the curve of a golf swing, it forces trolley pulley 35 downward, which also moves resistance cord 37 downward, which in turn moves lower double pulley 42 upward toward upper double pulley 41. This extends spring 50, which resists the downward movement of trolley pulley 35. In effect, block and tackle 40 extends the force distance of spring 50 so that spring 50 can stretch a few inches for each foot of travel of trolley pulley 35. Different numbers of pulleys and different mechanical advantages can be used in block and tackle 40 to accomplish this effect. Resistance biases other than springs can also be used, such as weights or elastic cords or tubing, and block and tackle systems may be varied or perhaps eliminated, depending upon the resistance bias chosen.

Since the resistance force of springs 50 connected to lower pulley 42 increases as springs 50 are extended, resistance to movement of handle 10 increases as trolley pulley 35 moves further downward during a golf swing. This appropriately increases the force required to move handle 10 as handle 10 approaches the hitting region. Moreover, movement of handle 10 into the hitting region, as shown in FIG. 6, requires more downward movement of pulley 35 than equivalent movement of handle 10 in a back swing region, which also increases the resistance force to handle movement. In effect, a golf exerciser meets substantially increased resistance in moving handle 10 through the last few increments of motion into the hitting region, which effectively provides a better workout for the muscles required in applying hitting power.

FIG. 8B illustrates a preferred resistance arrangement for the two resistance cord system illustrated in FIGS. 3–5 and it does so in a way similar to the illustration of FIG. 8A. Lower resistance cord 15 passes over trolley pulley 35 and down to a fixed connection at lower track region 26 in the same way as shown in FIG. 8A. This causes downward movement of trolley pulley 35 as handle 10 advances, as previously explained, and such downward movement is resisted by cord 37 reeved through block and tackle 40 connected to resistance bias 50.

Upper resistance cord 16 is reeved over upper trolley pulley 36, and down to a pulley 34 connected to track bottom region 26 and back upward to a connection 33 with trolley pulley 36. This arrangement results in movement of handle 10 causing trolley pulley 36 to move downward at only half the rate of trolley pulley 35.

Downward movement of trolley pulley 36 is resisted by a block and tackle 55 using pulleys 56 and 57 connected to one or more bias resistance springs 50. The cord 58 reeved from pulley trolley 36 through block and tackle 55 ends at an upper termination 59. Since block and tackle 55 has a smaller mechanical advantage than block and tackle 40, extension movement of spring 50 connected to pulley 57 is not amplified over as long a distance. On the other hand, the mechanical advantage applied to resistance cord 16 is arranged to move trolley pulley 36 only half as far as trolley pulley 35.

Although the illustrated preferred embodiments use track 20 and trolleys 30, substitutes for these are available. A run formed of pipe or tubing for example could extend along either a straight or curved line while supporting a runner that surrounds or otherwise engages the run to move along the run as the handle moves through the golf swing. Elastic bands or cords can be substituted for resistance springs, and depending on how a resistance bias is arranged, pulleys and block and tackle systems may not be necessary. A resistance bias can also be formed gravitationally, pneumatically, or electromagnetically. For alternatives such as these, it remains important to provide a trolley or runner that can move along a track or run to vary the position of a resistance applied to a handle as the handle moves through a swing curve. Also, it is very desirable that the resistance bias system provide increased resistance as the handle approaches a hitting region.

The preferred embodiment of a track and trolley arrangement can also be varied. For example, a track with a pair of slots arranged side by side can accommodate a trolley in each slot, rather than arranging two trolleys in a single track slot. Moreover, separate slots or runs for separate trolleys can be spaced apart or arranged to follow different paths for varying the directions of the resistance forces applied to the handle during a swing.

Figure 11:
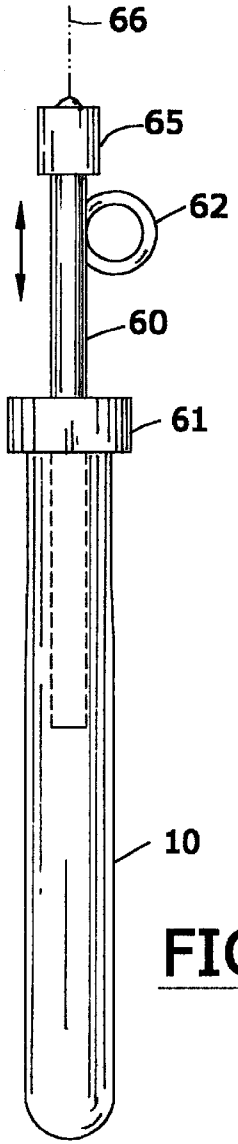
FIG. 11 is a partially schematic view of an exercise handle with a telescoping extendible connection for a resistance cord, and a light source projecting in a direction of a club shaft.

FIG. 11 illustrates a telescoping variation of handle 10 that can add further versatility. A locking collar 61 controls the adjustment of an extension bar 60 that can be variably extended from handle grip 10, as indicated by the double ended arrows. A connector ring 62 on extension rod 60 connects to one or more resistance cords, and varying the extension of rod 60 varies the distance from grip 10 at which resistance cords are connected. Extending rod 60 further outward from grip 10 requires the golf exerciser to use more force in driving the handle through the hitting region, because the resistance applied at ring 62 has a longer moment arm from grip 10. Conversely, shortening the extension of rod 60 reduces the moment arm of the resistance and lowers the force required by the golf exerciser to drive the handle through the hitting region.

A light 65 arranged on handle 10 directs a light beam 66 in the same direction that a golf shaft would extend from handle 10. By observing light beam 66, a golf exerciser can visually trace the path of an imaginary head of a golf club as the golfer moves handle 10 through a swing exercise. This can give the exerciser feedback of his success in moving handle 10 effectively through a desirable course for a golf swing.

Figure 12:
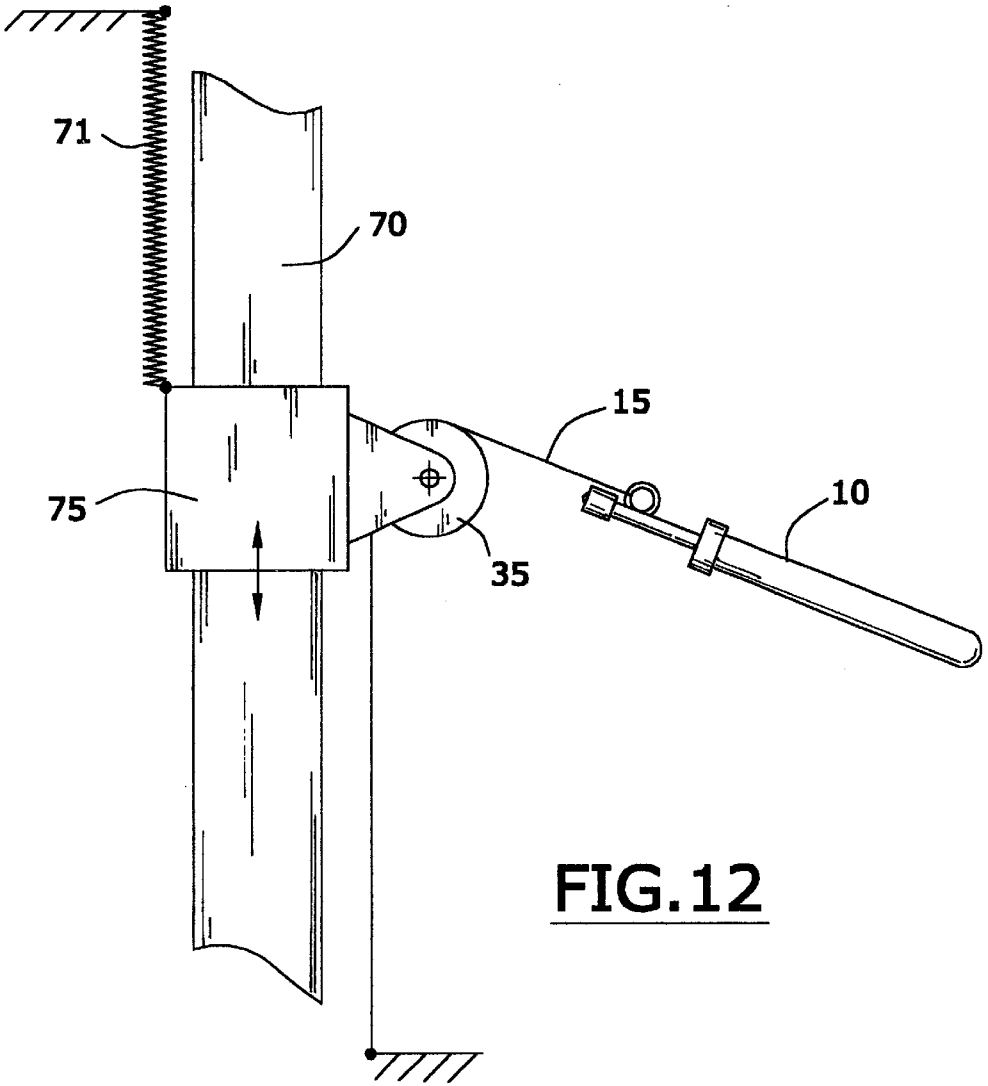
FIGS. 12 and 13 are fragmentary and partially schematic illustrations of two alternative versions of application of the invention to a runner and run that is not in the form of a trolley and track.
Figure 13:
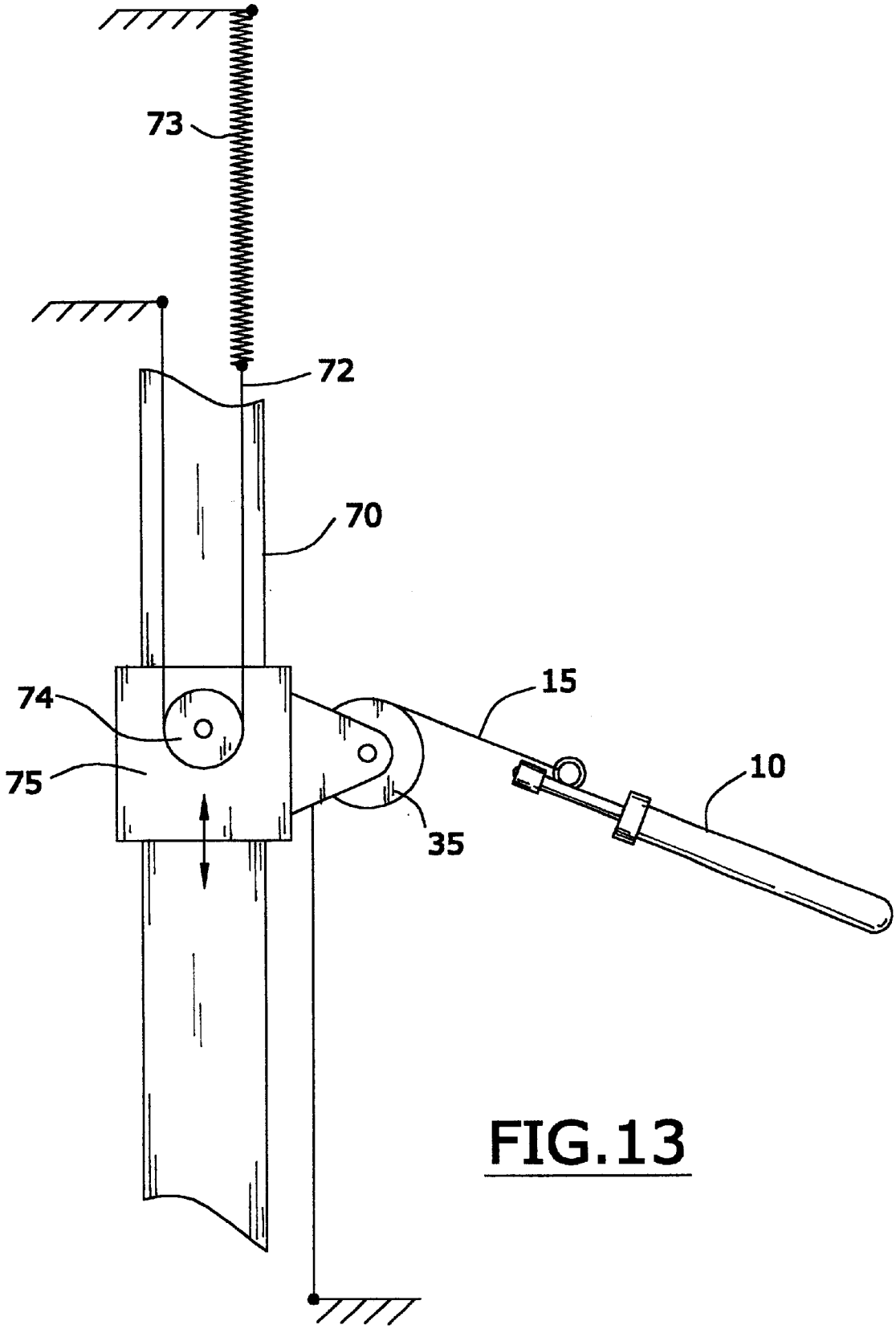

As shown in FIGS. 12 and 13, resistance runner 75 can be formed as a sleeve that surrounds and slides up and down run 70. A bearing system can be incorporated within runner 75, to assure smooth sliding motion. With runner 75 sliding externally of run 70, cords, pulleys, and resistance biases are exposed to view, rather than being concealed within channels of a track 20.

Handle 10 and cord 15 operate relative to pulley 35 in the same way as previously described for a track and trolley system. A resistance system in the form of an extension spring 71 resists downward movement of runner 75, and such a resistance can have many forms. Instead of the illustrated spring 71, a resistance system for runner 75 can include elastic cords, pneumatics, and other forms of transducers.

The variation schematically illustrated in FIG. 13 differs from the FIG. 12 embodiment by lengthening a resistance system for runner 75. Resistance bias 73 connects to a cord 72 reeved over a pulley 74 as a way of amplifying or lengthening the resistance path of runner 75. Instead of spring 73, attached to cord 72, the variation of FIG. 13 can use an elastic cord reeved over pulley 74. Also, lengthening of a resistance system can use a block and tackle arrangement such as illustrated in FIGS. 8A and 8B.

The run and runner systems of FIGS. 12 and 13 can also be applied to a double runner and double cord arrangement similar to the one illustrated in FIG. 8B. A pair of runners 75 can be arranged on a single run 70, or a pair of adjacent runs 70 can each support a runner 75, for a double cord and double resistance system. Either way, one of the runners 75 preferably moves only part way down a run 70, while its companion runner moves farther down a run 70.

Many other forms of runs and runners are also possible. Optimum choice depends on appearance and functioning of resistance systems to be used.

I claim:

1. A golf swing exerciser comprising:

a) a resistance cord attached to a golf handle so that a golfer can move the handle through a curve of a simulated golf swing against resistance applied to the handle via the cord;

b) the cord extending over a pulley arranged on a moveable trolley that is biased upward;

c) the cord extending from the pulley to a fixed region below a predetermined range of travel of the trolley;

d) the pulley, cord, and trolley being arranged relative to the curve followed by the handle during the simulated golf swing so that the handle moves away from the trolley as the simulated golf swing proceeds, causing the handle to pull the cord over the trolley pulley as the swing proceeds;

e) movement of the cord over the pulley during the simulated golf swing being arranged to force the trolley downward against the bias to resist movement of the cord and of the handle for exercise purposes; and f) the trolley being arranged to move along a track positioned relative to the curve of the golf swing so that the curve moves farther away from the trolley and the track as the swing proceeds toward a hitting region, and this increases movement of the trolley and increases cord resistance as the swing approaches the hitting region.

2. The golf swing exerciser of claim 1, wherein the trolley is biased by a selectable plurality of springs.

3. The golf swing exerciser of claim 2, wherein a block and tackle connects the springs to the trolley.

4. The golf swing exerciser of claim 1, wherein an extent of the cord between the handle and the-trolley is approximately horizontal as the swing approaches the hitting region.

5. The golf swing exerciser of claim 1, wherein the trolley is an upper trolley, an upwardly biased lower trolley is arranged below the upper trolley to run along the track, a lower cord is attached to the handle to extend over a pulley on the lower trolley, and the lower trolley is arranged to move farther along the track than the upper trolley during the simulated golf swing.

6. The golf swing exerciser of claim 5, wherein the cord to the upper trolley is reeved over a pulley block interposed between a fixed end of the upper cord and the pulley on the upper trolley while the lower cord runs directly from a fixed end over the pulley on the lower trolley.

7. The golf swing exerciser of claim 5, wherein the cords to the upper and lower trolleys are respectively above and below horizontal when the swing reaches the hitting region.

8. The golf swing exerciser of claim 1, wherein the track is formed as a run and the trolley is formed as a runner arranged to move along the run as the swing proceeds toward the hitting region.

9. A golf exerciser comprising;

a) a run arranged on a swing side of a golfer in a golf stance to extend from above and behind the golfer's shoulders downward to forward and below the golfer's hips;

b) a runner moveable downward along the run from an upper region of the run to a lower region of the run;

c) a bias arranged to resist movement of the runner downward along the run and to return the runner upward along the run from any downward position;

d) a pulley arranged on the runner;

e) a cord extending from an exercising end of a golf handle over the pulley on the runner and downward to a fixed region of the run; and f) the run, runner, bias, pulley, cord, and handle being arranged so that as the golfer moves the handle through a simulated golf swing, the handle pulls the cord over the pulley and draws the runner downward along the run against the resistance of the bias.

10. The golf exerciser of claim 9, wherein a distance of the exercising end of the handle from the pulley increases as the swing proceeds toward a hitting region, and resistance of the bias increases as the swing approaches the hitting region.

11. The golf exerciser of claim 9, wherein resistance to movement of the exercising end of the handle as transmitted by the cord is approximately horizontal as the swing approaches the hitting region.

12. The golf exerciser of claim 9, wherein the bias comprises a selectable plurality of springs connectable to the runner.

13. The golf exerciser of claim 9, wherein a connection between the cord and the handle is at a variable distance from a grip region of the handle.

14. The golf exerciser of claim 9, wherein the handle includes a light source directing a beam to project from the handle in a shaft direction.

15. The golf exerciser of claim 9, wherein the runner is an upper runner and including a lower runner arranged in the run below the upper runner, the lower runner having a lower bias connected to the lower runner and the lower runner being arranged to move farther than the upper runner as the swing proceeds.

16. The golf exerciser of claim 15, wherein the cord to the upper runner pulley and the cord to the lower runner pulley are respectively angled above and below horizontal as the swing reaches the hitting region.

17. The golf exerciser of claim 16, wherein the upper and lower biases each comprise a selectable plurality of springs connectable respectively to the upper and lower runners.

18. The golf exerciser of claim 9, wherein the run comprises a slotted run, and the runner comprises a runner arranged within the run so that a cord extending from the handle to the runner moves along the slot.

19. A swing exerciser comprising;

a) a run configured to form a line and a runner arranged to move along the run;

b) a spring arranged to bias the runner toward a starting end region of the run so that the spring resists movement of the runner along the run to a finishing end region of the run;

c) a pulley arranged on the runner to move with the runner;

d) a cord extending from the finishing end region of the run over the pulley on the runner and to a swing handle arranged to move in a curved swing path beginning near the runner at the starting end region of the run and curving away from the run so that movement of the handle pulls the cord away from the run, which pulls the runner along the run from the starting position to the finishing position against the bias of the spring; and e) the bias applied by the spring to the runner during the swing of the handle being transmitted to the handle from the cord over the pulley on the runner so that a line of resistance applied by the cord to the handle moves from the starting end region of the run to the finishing end region of the run as the swing progresses.

20. The swing exerciser of claim 19, wherein the spring is connected to the runner via a block and tackle.

21. The swing exerciser of claim 26, including a selectable plurality of the springs connectable to the runner via the block and tackle.

22. The swing exerciser of claim 19, wherein the line of resistance applied to the handle by the cord is approximately horizontal when the runner reaches the finishing end region of the run.

23. The swing exerciser of claim 19, wherein the resistance applied to the handle increases as the runner nears the finishing end region of the run.

24. The swing exerciser of claim 19, wherein the runner is an upper runner and including a lower runner moveable along the run in advance of the upper runner, the lower runner being biased toward the starting end region of the run, and a lower cord extending from the handle over a pulley on the lower runner to add to the resistance applied to the handle.

25. The swing exerciser of claim 24, wherein the cord to the upper runner and the cord to the lower runner angle respectively above and below horizontal as the runners reach finishing end region on the run.

26. The swing exerciser of claim 19, wherein the run is a slotted track and the runner is a trolley straddling the slot in the track.

27. A method of applying a variable resistance to a simulated golf swing for exercise purposes, the method comprising:

a) arranging a cord to extend from a golf handle over a pulley on a trolley and downward to a fixed region so that when a golfer moves the handle through a simulated golf swing the handle moves away from the trolley and pulls the cord over the trolley pulley to draw the trolley downward along a track;

b) upwardly biasing the trolley against downward movement along the track; and c) arranging the cord and trolley relative to a curve followed by the handle during the simulated golf swing so that movement of the handle causes increased movement of the trolley as the swing proceeds from a back swing region to a hitting region, and the increased movement of the trolley as the swing proceeds applies increasing resistance to the swing as the swing approaches the hitting region.

28. The method of claim 27, including biasing the trolley with a selectable plurality of springs connected to the trolley via a block and tackle.

29. The method of claim 27, including using a pair of the cords extending from the handle over a respective pair of the pulleys on respective trolleys arranged to move through different distances downward along the track as the swing progresses.

30. In a golf swing exerciser using a resistance cord attached to a golf handle so that a golfer can move the handle through a curve of a simulated golf swing against resistance applied to the handle via the cord, the improvement comprising;

a) the cord being operatively connected to a moveable runner so that movement of the cord during the simulated golf swing causes the runner to move;

b) the runner being biased to resist movement during the simulated golf swing and thereby apply resistance to the cord moving the runner so that the cord resists movement of the handle; and c) the cord and runner being arranged so that cord resistance applied to the handle during the simulated golf swing increases in force as the simulated golf swing proceeds from a back swing region to a hitting region.

31. The improvement of claim 30, wherein a selectable plurality of springs are arranged to bias the runner.

32. The improvement of claim 31, including a block and tackle arrangement connecting the bias springs to the runner.

33. The improvement of claim 30, wherein a second cord attaches to the golf handle and is operatively connected to a second runner that is also biased to resist movement, and the second runner moves half as far as the first named runner during the simulated golf swing.

34. The improvement of claim 30, wherein the runner comprises a trolley arranged to move along a slotted track so that the trolley straddles a slot in the track and the cord extends from the trolley through the slot to the handle.

35. A golf swing exerciser comprising:

a) a resistance applied to a golf handle so that a golfer can move the handle through a curve of a simulated golf swing against the resistance;

b) a pair of cords attached to the golf handle and extending to respective pulleys on respective moveable trolleys arranged to run along a track;

c) a fixed end of the lower-one of the cords being secured below a lower one of the trolleys, and a pulley block being interposed between a fixed end of an upper one of the cords and a pulley on the upper one of the trolleys so that as the handle pulls the cords away from the track while following the curve of the golf swing, the cords pull the lower trolley downward farther than the upper trolley is moved downward;

d) each of the trolleys being biased against downward movement; and e) the curve of the golf swing being arranged relative to the trolley track so that the cords are pulled more rapidly away from the track as the swing approaches a hitting region to result in greater resistance applied to the handle as the simulated golf swing approaches the hitting region.

36. The golf swing exerciser of claim 35, including a selectable plurality of springs connectable to the respective trolleys.

37. The golf swing exerciser of claim 36, including a block and tackle arranged for connecting the springs respectively to each of the trolleys.

38. The golf swing exerciser of claim 35, wherein the cords extend above and below horizontal as the golf swing reaches the hitting region.

* * * * *